US006569823B2

(12) United States Patent
Mooney

(10) Patent No.: US 6,569,823 B2
(45) Date of Patent: May 27, 2003

(54) FABRIC CARE COMPOSITION

(75) Inventor: William Mooney, Bebington (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 22 days.

(21) Appl. No.: 09/833,532

(22) Filed: Apr. 12, 2001

(65) Prior Publication Data

US 2001/0044400 A1 Nov. 22, 2001

(30) Foreign Application Priority Data

Apr. 14, 2000 (GB) ..... 0009343

(51) Int. Cl.[7] ..... C11D 3/37; C11D 3/50
(52) U.S. Cl. ..... 510/101; 510/475
(58) Field of Search ..... 510/475, 101

(56) References Cited

U.S. PATENT DOCUMENTS

| | | | | |
|---|---|---|---|---|
| 2,926,154 A | * | 2/1960 | Keim | 260/29.2 |
| 4,003,846 A | * | 1/1977 | Kuhn et al. | 252/316 |
| 4,464,271 A | | 8/1984 | Munteanu et al. | |
| 5,652,206 A | | 7/1997 | Bacon et al. | |

FOREIGN PATENT DOCUMENTS

| | | |
|---|---|---|
| EP | 0 332 259 | 9/1989 |
| EP | 0 404 470 | 12/1990 |
| EP | 0 430 315 A | 6/1991 |
| EP | 0 545 556 A | 6/1993 |
| WO | 96/21715 | 7/1996 |
| WO | 97/31094 | 8/1997 |
| WO | 98/29530 | 7/1998 |
| WO | 00/08127 | 2/2000 |
| WO | 00/15747 | 3/2000 |

OTHER PUBLICATIONS

UK Search Report/Application No. GB 0009343.5/Jun. 27, 2000.

PCT Search Report No. PCT/EP 01/03589—dated Aug. 30, 2001—3 pp.

* cited by examiner

*Primary Examiner*—John Hardee
(74) *Attorney, Agent, or Firm*—Alan A. Bornstein

(57) ABSTRACT

A fabric care composition comprises a perfume and a compound which is obtainable by the reaction of epichlorohydrin with an amine. The amine is a derivative of a polyamine in which at least one but not all of the amino groups bear long chain acyl groups. The compound or the composition may be used to soften and/or condition fabric during a laundering process.

9 Claims, No Drawings

FABRIC CARE COMPOSITION

This invention relates to a fabric care composition, to the use of the composition during a laundering process and to a method of treating a fabric using the composition.

BACKGROUND AND PRIOR ART

Fabric softening and/or conditioning compositions are known to impart benefits to fabric. Such compositions are generally applied to the fabric during the rinse cycle of a domestic laundering process. Fabrics treated with the compositions generally have a softer feel and improved handle compared to untreated fabric.

A number of compounds are known to act as fabric softening and/or conditioning agents. Generally, these are delivered to the fabric during the rinse cycle of a laundering process. These known compounds include quaternary ammonium compounds such as so-called Hamburg quaternary ester (HEQ) ie, 1,2-bis[hardened tallowoyloxy]-3-trimethylammonium-propane chloride.

The known fabric softening and/or conditioning compounds can provide a degree of resistance to creasing in the fabric. However, there remains a need for fabric softening and/or conditioning compounds which can impart a greater crease resistance.

The present invention relates to fabric softening and/or conditioning compositions which can impart improved crease resistance to fabrics relative to conventional compositions. The compositions of the invention also exhibit other advantages; fabrics treated with the compositions can have greater bulk, better in-wear fabric flow, improved drape and creasing properties and reduced folding and storage creasing.

Certain cationic compositions obtained by the reaction of epichlorohydrin with compounds having amino and amide functional groups, the compounds being formed by the acylation with long chain acyl groups of tetraethylene pentamine, have been used in the treatment of textiles. However, these treatments are applied industrially and do not form part of a fabric laundering process. The treatments have been applied as part of the cycle for dyeing acrylic fibers and as a finish in industrial processes.

DEFINITION OF THE INVENTION

According to the present invention, there is provided a fabric care composition comprising a perfume and a compound which is obtainable by the reaction of epichlorohydrin with an amine, wherein the amine is a derivative of a polyamine in which some but not all of the amino groups bear long chain acyl groups.

The invention also provides the use of a composition of the invention or of a compound used in the compositions of the invention to soften and/or condition fabric during a laundering process.

Further provided by the invention is a method of treating a fabric which comprises applying to the fabric a composition of the invention or a compound used in the compositions of the invention as part of a laundering process.

DERAILED DESCRIPTION OF THE INVENTION

The present invention involves fabric care compositions which comprise a perfume and a compound which is obtainable by the reaction of epichlorohydrin with an amine.

The perfume will generally be present in the composition in a relatively minor amount compared to the amount of the compound. Preferably, the perfume is present in an amount of up to about 5% by weight of the composition, more preferably up to 1% by weight, most preferably 0.001% to 1% by weight. The perfume may be a single compound or a mixture of different compounds. Any of the perfumes which are known for use in fabric care compositions, such as domestic detergent or fabric conditioning compositions, may be used in the compositions of the invention, although other perfumes may be employed in addition or instead. Examples of perfumes which may be used in the compositions of the invention are those described in, for instance, EP-A-0545556, EP-A-0332259, EP-A-0430315, EP-A-0404470, U.S. Pat. No. 5652206 and WO 97/31094.

The compound which is used in the compositions of the invention is obtainable by the reaction of epichlorohydrin with an amine. It will be appreciated that the reaction product formed by the reaction of epichlorohydrin with the amine may be a mixture of different compounds. The compound used in the composition of the invention is preferably in the form of this mixture. Alternatively, the compound may be a partly or substantially completely purified product obtainable from the reaction product.

The amine which is reacted with epichlorohydrin to form the compound is a derivative of a polyamine. The polyamine is preferably a linear polymer. The polyamine preferably has at least 3 nitrogen atoms in the polymer chain, including any nitrogen atoms in the end groups of the polymer chain. More preferably, the polyamine has from 3 to 10 nitrogen atoms in the polymer chain (including its end groups), most preferably 3 to 7 nitrogen atoms, such as 5 nitrogen atoms (eg, the polyamine may have a backbone based on tetraethylene pentamine). Preferably, the nitrogen atoms form part of primary or secondary amino groups in the underivatised polyamine. The nitrogen atoms within and at the end of the chain are linked by any suitable linker groups. Linker groups include alkylene groups, such as $C_1$ to $C_8$ alkylene (eg, ethylene or propylene), optionally containing other atoms or groups in or on the alkylene groups eg, amide groups in the alkylene chain or alkyl or hydroxyl groups on the alkylene chain.

The polyamines are modified, to form derivatives, such that at least one but not all of the nitrogen atoms bear long chain acyl groups. The amines therefore contain at least one amino group (ie, an amino group in the polyamine which is not acylated) and at least one amido group (ie, an amino group in the polyamine which has been acylated). The amines may contain only one amino group. The long chain acyl groups include —C(O)R groups, where R is $C_{10}$ to $C_{30}$ alkyl. The alkyl groups may be branched or unbranched, cyclic or linear. Preferably, the alkyl groups are unbranched and are linear. Advantageously, the alkyl groups are saturated and/or unsubstituted. However, the long chain in the acyl groups may contain double bonds and may be substituted in or on the chain. Preferably, the acyl groups include one or more n-$C_{22}H_{46}$—C(O)— groups. The polyamine may be acylated with one type of acyl group or with a mixture of different acyl groups, such as, for example, a mixture of acyl groups of different chain lengths.

The amines may be produced by acylation of the polyamine with a long chain acylating agent. Suitable acylating agents include fatty acids, fatty acid esters, fatty acid chlorides and fatty acid anhydrides. Preferably, the polyamine is acylated using a fatty acid. In a preferred embodiment of the invention, the reaction of the polyamine with the acylating agent can be represented by the following schematic reaction:

$$H_2N—(A—NH)_n—A—NH_2 \xrightarrow{RCOX} R'—HN—B—NHR'$$

wherein:

A is an alkylene chain (eg, $C_1$ to $C_6$);

R is a long chain alkyl group (eg, $C_{10}$ to $C_{30}$);

X is a leaving group such as OH or Cl;

n is an integer from 1 to 8;

each R' is, independently, H or COR; and

B contains at least one (A—NH) group and at least one (A—N(COR)) group, the total number of both groups being equal to n.

Preferably, B contains more (A—N(COR)) groups than (A—NH) groups and, desirably, there are n+1 COR groups in the compound of formula R'HN—B—NHR'.

The compound of formula R'HN—B—NHR', which may be in the form of a mixture of different compounds, is reacted with epichlorohydrin to form the compound which may be used in the fabric care compositions of the invention. The epichlorohydrin is preferably reacted with the amine in an amount of from 0.25 to 0.75 molar equivalents. Conditions for the acylation reaction are well-known in the art. Preferably, from n to n+1.5 molar equivalents of acylating agent are reacted with the compound of formula $H_2N—(A—NH)_n—A—NH_2$ eg, from 3 to 4.5 molar equivalents of acylating agent may be reacted with a pentamine (for example, tetraethylene pentamine). The reaction is preferably carried out in the absence or substantial absence of air (eg, in the presence of an inert gas such as nitrogen or argon).

When a fatty acid is employed as the acylating agent, the reaction is preferably carried out at an elevated temperature of over 100° C. (preferably 110 to 220° C.) with the water which is formed in the reaction being distilled out of the reaction mixture. The extent of the reaction can be monitored by determining the amount of water which is formed in the reaction, in ways which are well-known to those skilled in the art. Although a solvent may be included in the reaction mixture, the reaction is preferably carried out in the absence of a solvent. The reaction is typically carried out in the presence of a catalyst. Suitable catalysts include acids eg, phosphoric acid, preferably concentrated.

The product of the acylation reaction in which the amine is formed may be directly reacted with epichlorohydrin without further purification. Alternatively, the polyamine may be partially or fully purified prior to reaction with epichlorohydrin. The reaction of the amine with epichlorohydrin is typically carried out at an elevated temperature of 50° C. to 110° C., with the epichlorohydrin preferably being added to the amine. The reaction is preferably carried out in the absence of a solvent. A catalyst for the reaction (such as $BF_3$ eg, as its etherate) is typically present in the reaction mixture. The product of the reaction may be partly purified (eg, by water washing or solvent extraction to remove any unreacted epichlorohydrin) or, where the product contains no unreacted epichlorohydrin, may be used as such in the fabric conditioning compositions of the invention.

The fabric care composition of the invention is conveniently prepared as an aqueous dispersion, suspension or emulsion. The compound (or mixture of compounds) is preferably present in the composition in an amount of up to 10% by weight, most preferably from 3% to 8% by weight. In addition to the perfume, the compositions may contain other additives including color and/or other fabric softening and/or conditioning agents.

The aqueous dispersion, suspension or emulsion is preferably prepared by mixing the compound with water at an elevated temperature, such as from 50 to 105° C., preferably in the presence of an emulsifying agent. Emulsifying agents which may be used include nonionic emulsifying agents such as cocoa 20 EO, Genapol™ (Hoechst, Germany), Ethylan C160™ or Synperonic $A_{20}$™. The selection of a suitable emulsifying agent depends on the particular formulation and the manufacturing techniques employed and can be readily made by those skilled in the art. A fabric care composition of the invention may be prepared by adding perfume (and any other desired additives) to the aqueous dispersion, suspension or emulsion at any stage of the process for preparing the dispersion, suspension or emulsion, including before, or preferably, after the process.

The fabric care compositions may be used to soften and/or condition fabric during a laundering process. Laundering processes include large scale and small scale (eg, domestic) laundering processes. Preferably, the fabric care compositions are packaged and labelled for use in a domestic laundering process.

The fabric care composition is used in a method of treating fabric which comprises applying the-composition to (ie, bringing the composition into contact with) the fabric. Preferably, the composition is applied to the fabric during the rinse cycle of the laundering process (ie, after the fabric has been treated with a detergent composition).

The fabric which may be treated in the method of the invention may be in the form of a garment. Suitable fabrics include those of cotton (woven or knitted) and its mixtures with synthetics and also wool and silk. Other fabrics of natural and synthetic fibers, and mixtures thereof, may also be treated in the method of the invention.

The fabric care compositions of the invention have the advantage of imparting a relatively "dry, non-greasy" feel to fabrics, compared to fabrics treated with conventional compositions. Fabric treated with the compositions of the invention can also have the advantage of increased bulk, easier ironing (including easier garment manipulation on the ironing board, reduced creasing during ironing and some protection against recurrent seam distortion), reduced creasing on storage and enhanced hydrophobicity (thus giving greater water resistance).

Fabric care compositions suitable for delivery during the rinse cycle may also be delivered to the fabric in the tumble dryer if used in a suitable form. Thus, another product form for the compositions of the invention is a composition (for example, a paste) suitable for coating onto, and delivery from, a substrate e.g. a flexible sheet or sponge or a suitable dispenser during a tumble dryer cycle.

The compositions of the invention may contain one or more known fabric softening and/or conditioning agents, such as quaternary ammonium compounds eg, HEQ.

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other softening agent(s) to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material and/or other softening agent(s) to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and non-ionic surfactants.

The fabric conditioning compositions may also include an agent which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight and pH buffering agents.

Further optional ingredients include non-aqueous solvents, perfume carriers, fluorescers, colorants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The invention will now be described by way of example only and with reference to the following non-limiting examples.

EXAMPLES

1. Oligomeric Polyamine/amide Preparation

Behenic acid (256.2 g), tetraethylene pentamine (37.8 g) and 90% phosphoric acid (0.3 g) are charged to a 1 liter reaction vessel. The vessel is flushed with nitrogen to remove air. The flow rate of the nitrogen is reduced and the mixture is heated to 80° C. A condenser is fitted to the vessel to remove the water formed in the reaction. The temperature is slowly increased to 180° C. and completion of the reaction is assessed by monitoring the amount of water formed.

When the reaction is complete, the mixture is cooled to 100° C. and epichlorohydrin (9 g) is slowly added from a dropping funnel in the presence of $BF_3$ (3 g) as catalyst. The reaction was complete after about 3 hours.

2. Preparation of Rinse Conditioning Dispersion

The product from 1, without purification or any other treatment, was put into a reaction vessel and heated to 110° C. Separately, water (20:1 by weight based on product of 1) containing 2.5% by weight emulsifier (Ethylan C160™) was heated to 90° C. About 10% by weight of the water containing the emulsifier was added to the molten product from 1 with stirring. The temperature of the resulting mixture was adjusted to 98° C. to 105° C. A second aliquot of water was then added and the temperature maintained at 98° C. to 105° C. for 60 minutes with stirring. Half of the remaining water was added and the temperature maintained at 80° C. to 100° C. with stirring for 60 minutes. The temperature was then allowed to drop to 50° C., the remaining water was added and the mixture was allowed to cool to room temperature. The resulting mixture was filtered through a 20 $\mu$m mesh and color and perfume were added. The dispersion is slightly viscous.

3. Treatment of Fabric

Knitted cotton double jersey fabric was washed at 40° C. and a dispersion formed as in 2 was applied to the fabric at the rinse stage. A dispersion containing 5% total actives (ie, oligomeric amine) was compared with a standard rinse conditioner containing 5% of the quaternary ammonium fabric conditioning agent HEQ. After the rinse treatment, the fabric was tumble dried on an extra dry setting.

The treated fabric was subjected to the following tests:

a. Clenched Fist Test

A 30 cm×30 cm square of fabric was crumpled and squeezed by hand for 5 seconds. The fabric was then gently shaken out and creasing was assessed according to the AATCC wrinkle rating for five repeats. The higher the rating, the less creased the fabric. The results were as follows:

| Treatment | AATCC Wrinkle Rating |
|---|---|
| None | <1 |
| Dispersion from 2 | 2.5 |
| HEQ | 1.5 |

b. Bulk Test

A 90 cm×30 cm piece of fabric was folded four times and the height of the folded edge was measured, indicating the bulk of 16 layers. The results were as follows:

| Treatment | Layer Thickness (cm) |
|---|---|
| None | 2.60 |
| Dispersion from 2 | 3.25 |
| HEQ | 2.86 |

c. Storage Creasing

Samples of fabric measuring 90 cm×30 cm were folded four times and then subjected to a compression of 1 kgf for 7 days. The fabric was then opened out and the creases rated against the AATCC standard. The results were as follows:

| Treatment | AATCC Wrinkle Rating |
|---|---|
| None | 2.0 |
| Dispersion from 2 | 3.5 |
| HEQ | 2.5 |

d. Wetting Properties

A most desirable comfort property of wool and natural cotton is their high affinity for molecular moisture by way of regain at the same time as having a repellence to liquid water drops. Wool and unprepared cotton are naturally hydrophobic as a result of a fatty epicuticle or high molecular weight waxes on the surface. At the same time these fibers will absorb high levels of gaseous water from a humid atmosphere. This contradictory character is strongly associated with the highly appreciated comfort of natural fibers. The light shower-proof characteristic of these fibers, in particular woollen and worsted garments, is very useful and desirable. The preferred formulation discussed herein rejuvenates this character. This test, based on the time taken for fabric to absorb a single drop of water, on polyester/cotton shirts demonstrates the hydrophobing effect.

| Treatment | Time taken to absorb water drop (s) |
|---|---|
| None | 5 |
| Dispersion from 2 | 60 |
| HEQ | 15 |

e. Creasing of Garments

Polyester shirts were washed at 40° C. in Persil (trade mark) detergent with a 5% addition of the dispersion from 2 made at the rinse stage. The shirts were then tumble dried on the extra dry setting. Wrinkle rating out of tumble drying was assessed against AATCC standards. The shirts were then folded and allowed to age for 1 week. The storage folding creases were then rated in a similar manner.

| | AATCC Wrinkle Rating | |
|---|---|---|
| Treatment | Out of dryer | After storage |
| None | 1.5 | 0.5 |
| Dispersion from 2 | 2.5 | 1.5 |
| HEQ | 2.0 | 1.0 |

This shows that a worthwhile reduction in the creases generated in tumble drying is achieved. The folding creases take on a less objectional form and there is reduced creep in the fabric matrix over the storage time.

What is claimed is:

1. Fabric care composition comprising a perfume and a compound which is obtainable by the reaction of epichlorohydrin with an amine, wherein the amine is a derivative of a polyamine in which at least one but not all of the amino groups bear long chain acyl groups of the formula —C(O)R in which R is $C_{10}$–$C_{30}$ alkyl.

2. Composition as claimed in claim 1, wherein the polyamine contains from three to ten amino groups.

3. Composition as claimed in claim 2, wherein the polyamine is tetraethylene pentamine.

4. Composition as claimed in claim 1 wherein epichlorohydrin is reacted with the amine in an amount of from 0.25 to 0.75 molar equivalents.

5. Composition as claimed in claim 1 wherein the acyl groups include one or more n-$C_{22}H_{45}$—C(O)— groups.

6. Composition as claimed in claim 1 which is a fabric softening and/or conditioning composition for delivery during the rinse cycle of a fabric laundering process.

7. Method of treating a fabric which comprises applying to the fabric a compound as defined claim 1 as part of a laundering process.

8. Method as claimed in claim 7, wherein the compound is in the form of a composition comprising a perfume and a compound which is obtainable by the reaction of epichlorohydrin with an amine, wherein the amine is a derivative of a polyamine in which at least one but not all of the amino groups bear long chain acyl groups.

9. Method as claimed in claim 8, wherein the composition is applied to the fabric during a rinse cycle of the laundering process.

* * * * *